United States Patent [19]

Menchetti et al.

[11] Patent Number: 4,704,837

[45] Date of Patent: Nov. 10, 1987

[54] WALL CONSTRUCTION

[75] Inventors: Robert J. Menchetti, Buffalo; Robert M. Chapman, North Tonawanda, both of N.Y.

[73] Assignee: National Gypsum Company, Dallas, Tex.

[21] Appl. No.: 896,967

[22] Filed: Aug. 15, 1986

[51] Int. Cl.[4] ..... E04C 2/00

[52] U.S. Cl. ..... 52/631; 52/71/273

[58] Field of Search ..... 52/631, 71, 70, 273

[56] References Cited

U.S. PATENT DOCUMENTS

| | | | |
|---|---|---|---|
| 3,557,840 | 1/1971 | Maybee | 52/631 X |
| 3,654,053 | 4/1972 | Toedter | 52/631 X |
| 3,731,449 | 5/1973 | Kephart | 52/631 |
| 3,911,554 | 10/1975 | Ford | 52/631 X |
| 4,024,684 | 5/1977 | Holmgren | 52/631 X |
| 4,402,170 | 9/1983 | Seidner | 52/631 |

FOREIGN PATENT DOCUMENTS

| | | | |
|---|---|---|---|
| 2700076 | 7/1978 | Fed. Rep. of Germany | 52/631 |
| 2905027 | 8/1979 | Fed. Rep. of Germany | 52/631 |
| 142366 | 6/1980 | German Democratic Rep. | 52/631 |

*Primary Examiner*—J. Karl Bell

*Attorney, Agent, or Firm*—Robert F. Hause

[57] ABSTRACT

A wall construction wherein a sheet of paper covered gypsum wallboard has at least one V-shaped groove formed part way through the thickness of the wallboard, and a sheet of rigid bendable sheet metal, conforming to one surface of the wallboard, along the groove area, is laminated to the wallboard whereby folding of the wallboard and sheet metal, along the groove, closing the groove, results in a folded section which remains firmly folded by reason of the folded rigid sheet metal laminate.

12 Claims, 5 Drawing Figures

WALL CONSTRUCTION

BACKGROUND OF THE INVENTION

This invention relates to a wall construction system and particularly to a non-progressively constructed, demountable wall construction system employing folded gypsum board with bendable rigid elements for retaining the folded form which is essential for the wall stability.

U.S. Pat. No. 3,188,773 discloses a wall construction wherein paper covered gypsum wallboards are slit lengthwise part way through the wallboard, leaving the paper intact on one side to act as a hinge and a connecting element. The sections of wallboard are folded to a 90° corner at each slit. With three slits, four sections are formed, alternately narrow and wide, which when all folded to 90° corners produces a hollow elongate box, open at each end, whereby the narrow sections function as studs and the wide sections form opposed sections of wall base, of a hollow wall. A reinforcing strip of paper, adhered over the areas of wallboard paper to undergo folding and act as connecting elements, reinforces the paper hinge. Preformed metal clips at the two ends of the hollow elongate box act to hold the folded sections at the desired 90° relationship.

U.S. Pat. No. 4,000,594 discloses a wall construction wherein paper covered gypsum wallboards are slit and V-grooved lengthwise part way through the wallboard leaving the paper intact on one side to act as a hinge and a connecting element. The sections of wallboard are folded to a 90° corner at each slit and groove, with the sections being folded inwardly to effectively close the V-groove. With two groove-slits, three sections are formed one central wide section with a narrow section on each side, which when folded to 90° corners produces a wide, shallow channel-shaped unit. These units are assembled with other like units to form the two opposed faces of a hollow wall, held apart by the stud-like perpendicular narrow sections. The narrow sections are held at the 90° angle, relative to the central section, by an adhesive material, which adheres the two abutting sides of the V-groove together, when in the folded form.

SUMMARY OF THE INVENTION

The present invention is directed to a foldable wall panel unit and a demountable partition constructed therewith. The wall panel is made from a paper covered gypsum board and includes foldable rigid material affixed to the paper covered gypsum board in a relationship wherein the foldable rigid material will be caused to be folded along with the paper covered gypsum wallboard, and, by reason of the bendable but rigid nature of the material, will tend to hold the folded wallboard in the desired 90° relationship between adjacent sections.

It is an object of the present invention to provide a novel wall panel unit for constructing an economical, rapidly erected, demountable, non-progressive partition wall, suitable for shipping as a flat unit and being folded easily to a final firm form suitable instantly for erection.

It is a further object to provide a novel demountable partition of improved rigidity and permanence and also permit substantial economies in material and labor.

DESCRIPTION OF THE PREFERRED EMBODIMENTS

Figure 1:
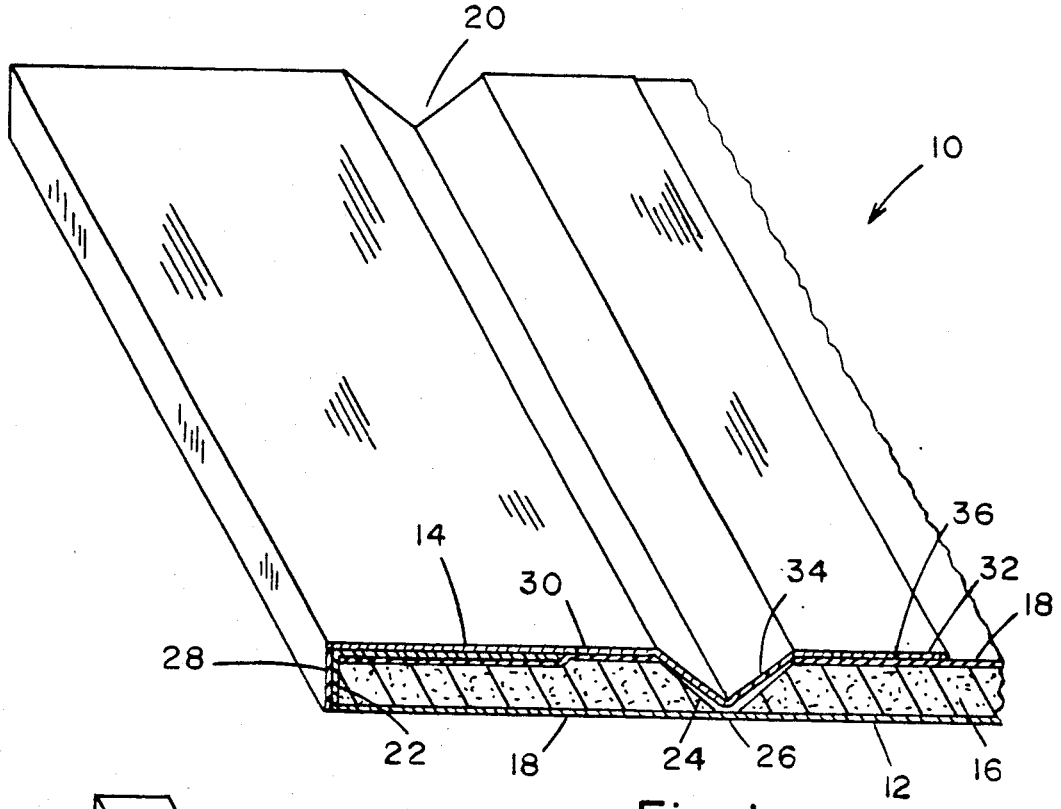
FIG. 1 is an isometric end view of a paper covered gypsum wallboard, grooved and laminated to a metal fold retainer, in accordance with the invention.

Referring to FIG. 1, there is shown a flat, unfolded wall panel unit 10 consisting essentially of a grooved, paper covered gypsum wallboard 12 and, laminated thereto, a narrow preformed sheet metal fold retainer 14.

Wallboard 12 has a core 16 of set gypsum surrounded by paper cover sheets 18. A V-groove 20 is formed part way through wallboard 12, centered approximately three inches from the side edge 22 of the wallboard 12. There is a similar V-groove (not shown) formed approximately three inches from the opposite wallboard side edge. Each V-groove 20 has side walls 24 extending downward at about a 40° angle with the board face, forming an angle of over 90°, preferably 100° to 110° with one another at the bottom of the groove, which terminates at the interface of the core 16 and the bottom cover sheet 18, leaving the bottom cover sheet 18 undisturbed preferably, a bare strip 26 of the bottom cover sheet about ⅛ inch wide is exposed in the forming of V-groove 20.

The metal fold retainer 14 is formed of sheet metal of about 0.015 inch thickness, from a strip of sheet metal having a width of about five inches. Fold retainer 14 is formed with a narrow end flange 28 adhered to the edge of wallboard 12 and two spaced apart face portions 30 and 32 which are separated by a V-shaped portion 34. The face portions 30 and 32 are adhered to the wallboard face 36, such as by a contact adhesive.

The V-shaped portion 34 is formed at an angle slightly greater than the angle which sidewalls 24 make with each other, so that the V-shaped portion is spaced slightly away from the sidewalls 24 and from the paper bare strip 26.

Figure 2:
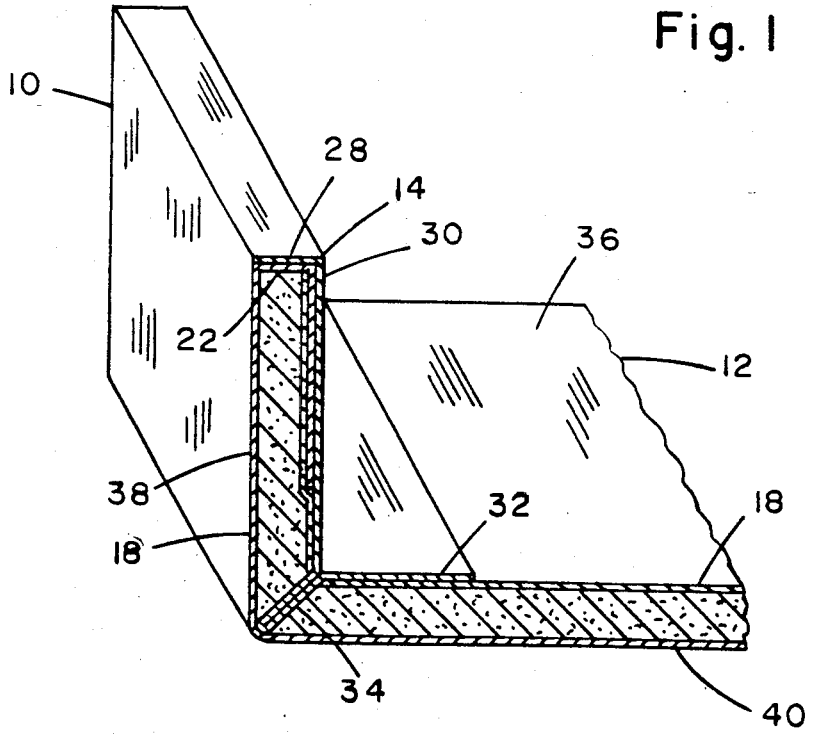
FIG. 2 is an isometric end view of the wallboard of FIG. 1, with the narrow edge section and the metal fold retainer to 90°, in accordance with the invention.

FIG. 2 shows the wall panel unit 10 folded as necessary for use in constructing a partition, with a narrow wallboard section 38 disposed at an angle of 90° relative to the central section 40 of wallboard 12. In order to form the 90° angle, the narrow section 38 is bent inwardly about 100° to 110° so that the fold retainer 14, also folded to 100° to 110°, will spring back to a 90° permanent fold. By the V-shaped portion 34 of fold retainer 14 being spaced from sidewalls 24 and paper bare strip 26, the board is able to be folded as described above without the V-shaped portion causing the paper to tear. The folded unit 10 thus consists of two narrow sections 38, of about three inch width, and a central section 40 which may be from about ten inches to fifty inches wide, preferably about twenty-four to thirty inches wide.

Figure 3:
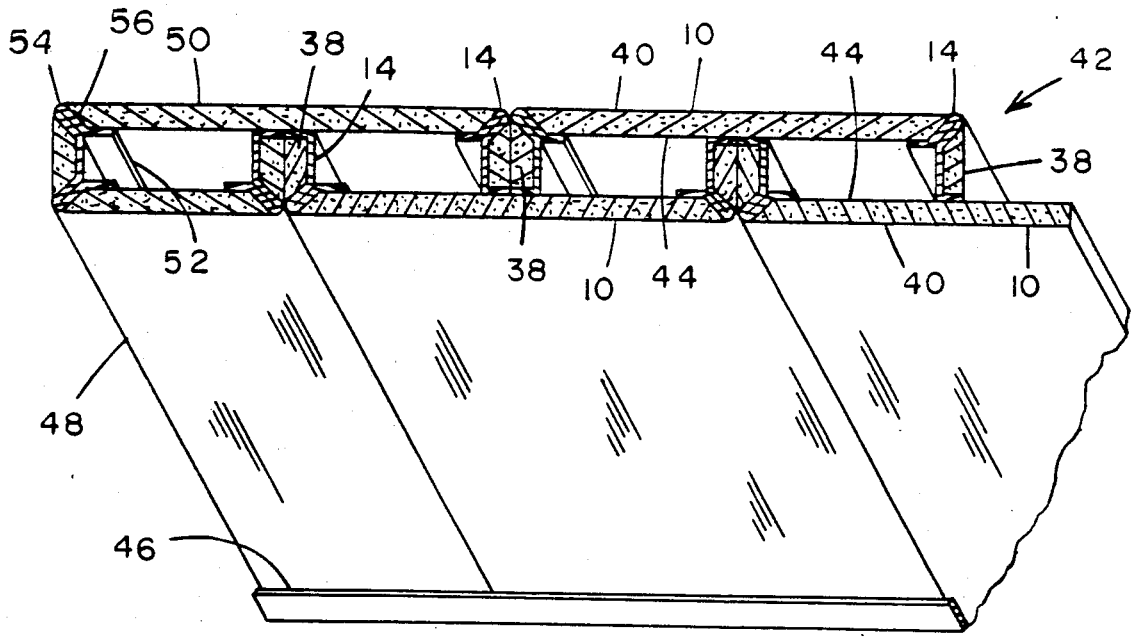
FIG. 3 is an isometric sectional plan view of a partition wall constructed with panels, as in FIG. 2.

FIG. 3 shows a partition 42 formed of several panel units 10 assembled, in their folded form, mounted in abutting relationship, side by side, and narrow sections 38 directed inwardly and disposed against the back side 44 of central section 40 on the opposite side of the wall, all mounted in a floor track 46 and a ceiling track (not shown.).

In accordance with the invention, the partition 42 includes a termination portion 48, formed in accordance with the invention, with a wallboard 50 and a double fold retainer 52, with folded portions 54 extending into the closed V-grooves 56 which form outside corners of the termination portion 48.

It is further contemplated, in accordance with the invention, that the novel structure of the termination portion 48 is readily adaptable for forming a wall termination of any type of hollow wall such as walls incorporating standard wood or metal studs. The double fold retainer 52 with the folded portions 54 extending into closed V-grooves 56 provide, essentially, two reinforced outside corners. It will also be readily apparent that a single outside corner can be provided in accordance with the invention using a single fold retainer (not shown) which is formed like one-half of a double fold retainer 52, providing reinforcement for a drywall outside corner structure.

Figure 4:
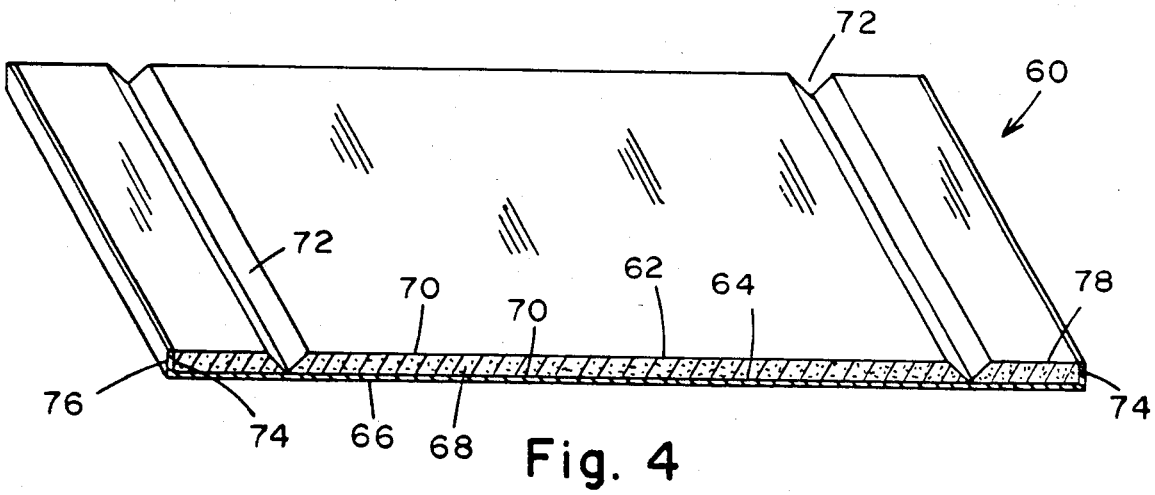
FIG. 4 is an isometric end view of a modified form of paper covered gypsum wallboard, grooved and laminated to a metal outside facing ply, in accordance with the invention.

Referring to FIG. 4, a modified form of the invention is shown in which a flat unfolded panel unit 60 consists essentially of a grooved, paper covered gypsum wallboard 62, and laminated thereto, on the entire wallboard front face 64, a sheet 66 of cold rolled predecorated sheet steel of about 0.024 inch thickness.

Wallboard 62 has a core 68 of set gypsum surrounded by paper cover sheet 70. A V-groove 72 is formed approximately three inches from each side edge 74, similar to V-grooves 20. The steel sheet 66 is adhered throughout the entire front face 64 and may include a short flange 76 extending onto each side edge 74.

Figure 5:
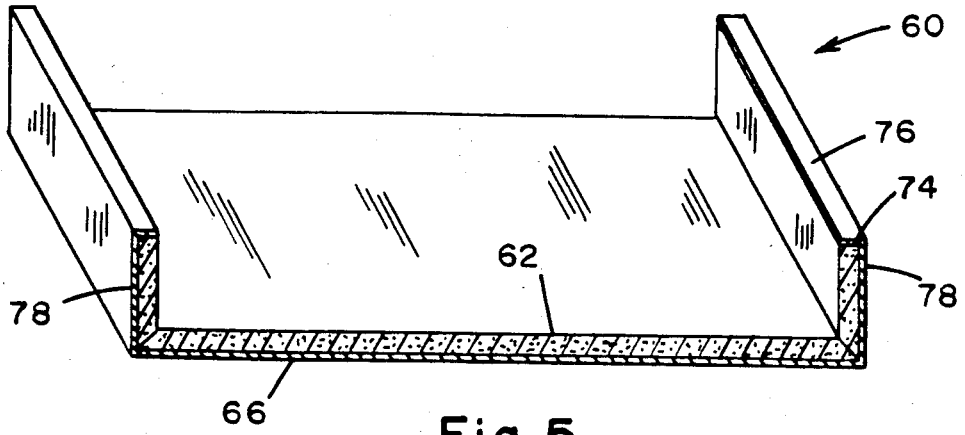
FIG. 5 is an isometric end view of the wallboard of FIG. 4, with the narrow edge section and the metal facing ply folded to 90°, in accordance with the invention.

FIG. 5 shows the wall panel unit 60 folded as necessary for use in constructing a partition, generally similar to the partition 42 described above. In forming the folded panel unit 60, the narrow sections 78 are folded inwardly about 100° to 110°, so that the steel sheet 66, also folded to 100° to 110°, will spring back to a 90° permanent fold.

Having completed a detailed disclosure of the preferred embodiments of the invention so that those skilled in the art may practice the same, we contemplate that variations may be made without departing from the essence of the invention.

We claim:

1. A wall panel unit comprising a single piece, paper covered gypsum wallboard having spaced grooves and, laminated thereto, a sheet of bendable rigid sheet metal in the area of each said groove, said grooves having a V-shape of an angle of about 100° and being parallel to and located about three inches from each longitudinal edge of said wallboard, said grooves having a depth equal to the thickness of one layer of paper plus the thickness of the gypsum core, and said laminated sheet metal being disposed on said wallboard in the areas of said grooves and being shaped to substantially conform to the abutting surface of said wallboard to which said sheet metal is laminated, whereby said wallboard and said metal may be simultaneously bent to substantially close said groove and to remain bent while free of any adhesive in said groove by said rigid bent sheet metal which is laminated to said wallboard.

2. A wall panel unit as defined in claim 1 wherein said sheet metal is in the form of a narrow sheet metal fold retainer and is laminated to the side of said wallboard which is grooved with said sheet metal fold retainer being shaped to extend into said groove to a depth close to, but not contacting, the paper at the bottom of said groove.

3. A wall panel unit as defined in claim 2 wherein there are two said sheet metal fold retainers each having a width extending from the area of one edge of said wallboard across the area of an adjacent groove and onto an area of ungrooved wallboard on the side of said groove remote from said edge, and said sheet metal fold retainers are firmly bonded to said wallboard on both sides of said grooves.

4. A wall panel unit as defined in claim 3 wherein each said sheet metal fold retainer has a narrow end flange adhered to an edge of said wallboard.

5. A wall panel unit as defined in claim 3 wherein said sheet metal fold retainers are each about five inches wide.

6. A wall panel unit as defined in claim 1 wherein said sheet metal is laminated to the side of said wallboard opposite to the side which is grooved.

7. A wall panel unit as defined in claim 6 wherein said sheet metal extends substantially throughout said side of said wallboard opposite to the side which is grooved.

8. A wall panel unit as defined in claim 7 wherein said sheet metal includes a short flange on each side extending onto the edge of said wallboard.

9. A wall comprising a plurality of folded wall panel units formed by folding the unfolded wall panel units defined in claim 1, said folded wall panel units having two narrow sections about three inches wide and a central section extending therebetween of a width of about 10 to 50 inches, said narrow sections extending perpendicularly from the two side of said central section and abutting the inner face of oppositely facing folded wall panel units, whereby a studless hollow wall is formed with a thickness equal to about three inches plus the wallboard thickness.

10. A wall as defined in claim 9 wherein said central section has a width of about 24 to 30 inches.

11. A wall termination unit comprising a single piece, paper covered gypsum wallboard having spaced grooves and, laminated thereto, a sheet of bendable rigid sheet metal in the area of each said groove, said grooves having a V-shape of an angle of about 100° and being parallel and about three inches apart, said grooves having a depth equal to the thickness of one layer of paper plus the thickness of the gypsum core, and said laminated sheet metal being disposed on said wallboard in the areas of said grooves and being shaped to substantially conform to the abutting surface of said wallboard to which said sheet metal is laminated, whereby said wallboard and said sheet metal may be simultaneously bent to substantially close said groove and to remain bent while free of any adhesive in said groove by said rigid bent sheet metal which is laminated to said wallboard.

12. A wall corner unit comprising a single piece, paper covered gypsum wallboard having a groove and, laminated thereto, a sheet of bendable rigid sheet metal in the area of said groove, said groove having a V-shape of an angle of about 100° , said groove having a depth equal to the thickness of one layer of paper plus the thickness of the gypsum core, and said laminated sheet metal being disposed on said wallboard in the area of said groove and being shaped to substantially conform to the abutting surface of said wallboard to which said sheet metal is laminated, whereby said wallboard and said sheet metal may be simultaneously bent to substantially close said groove and to remain bent while free of any adhesive in said groove by said rigid bent sheet metal which is laminated to said wallboard.

* * * * *

UNITED STATES PATENT AND TRADEMARK OFFICE

CERTIFICATE OF CORRECTION

PATENT NO. : 4,704,837

DATED : November 10, 1987

INVENTOR(S) : ROBERT J. MENCHETTI, ET AL.

It is certified that error appears in the above-identified patent and that said Letters Patent are hereby corrected as shown below:

Column 1, line 37: insert a comma after "formed".

Column 2, lines 38-39: insert a period after "undisturbed", and capitalize the "p" in "preferably".

Column 4, line 39: change "side" to ---sides---.

Signed and Sealed this

Seventeenth Day of May, 1988

*Attest:*

*Attesting Officer*

DONALD J. QUIGG

*Commissioner of Patents and Trademarks*